US008870341B2

(12) United States Patent
Hoisington et al.

(10) Patent No.: US 8,870,341 B2
(45) Date of Patent: Oct. 28, 2014

(54) NOZZLE PLATE MAINTENANCE FOR FLUID EJECTION DEVICES

(71) Applicant: FUJIFILM Corporation, Tokyo (JP)

(72) Inventors: Paul A. Hoisington, Hanover, NH (US); Andreas Bibl, Los Altos, CA (US); Jeffrey Birkmeyer, San Jose, CA (US); Mats G. Ottosson, Saltsjo-Boo (SE); Arman Hajati, Santa Clara, CA (US)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/657,669

(22) Filed: Oct. 22, 2012

(65) Prior Publication Data

US 2014/0111575 A1 Apr. 24, 2014

(51) Int. Cl.
*B41J 2/165* (2006.01)
*B41J 2/14* (2006.01)

(52) U.S. Cl.
CPC .... *B41J 2/16505* (2013.01); *B41J 2002/16502* (2013.01); *B41J 2/16552* (2013.01); *B41J 2002/16582* (2013.01); *B41J 2/1433* (2013.01)
USPC ..... 347/29

(58) Field of Classification Search
USPC ..... 347/20, 21, 22, 25, 28, 29
See application file for complete search history.

(56) References Cited

U.S. PATENT DOCUMENTS

| | | | | |
|---|---|---|---|---|
| 3,891,121 | A * | 6/1975 | Stoneburner | 222/1 |
| 4,613,875 | A | 9/1986 | Le et al. | |
| 5,786,829 | A * | 7/1998 | Pasciak et al. | 347/28 |
| 5,929,877 | A | 7/1999 | Hetzer et al. | |
| 7,490,921 | B2 * | 2/2009 | Hashi et al. | 347/29 |
| 2010/0255277 | A1 * | 10/2010 | Platt et al. | 428/215 |
| 2013/0141491 | A1 * | 6/2013 | Krichtman et al. | 347/30 |

OTHER PUBLICATIONS

Extended European Search Report in EP Application No. 13189694.6, dated Feb. 13, 2014, 8 pages.

* cited by examiner

*Primary Examiner* — Alessandro Amari
*Assistant Examiner* — Michael Konczal
(74) *Attorney, Agent, or Firm* — Fish & Richardson P.C.

(57) ABSTRACT

An ink jet printhead includes: a nozzle plate having an underside and including one or more nozzles in the underside configured to dispense drops of fluid in a dispensing direction; and a multi-level maintenance structure coupled to the nozzle plate such that a gap exists between a portion of the maintenance structure and the underside of the nozzle plate. The maintenance structure includes: a first portion having a first upper surface suspended at a first distance from the underside of the nozzle plate; and a second portion that is coupled to the first portion, the second portion having a second upper surface suspended at a second distance from the underside of the nozzle plate, which is greater than the first distance, the second upper surface laterally displaced relative to the first upper surface.

9 Claims, 8 Drawing Sheets

NOZZLE PLATE MAINTENANCE FOR FLUID EJECTION DEVICES

TECHNICAL FIELD

This specification generally relates to nozzle plate maintenance for fluid ejection devices.

BACKGROUND

In some fluid ejection devices, fluid droplets are ejected from one or more nozzles onto a medium. The nozzles are fluidically connected to a fluid path that includes a fluid pumping chamber. The fluid pumping chamber can be actuated by an actuator, which causes ejection of a fluid droplet. The medium can be moved relative to the fluid ejection device. The ejection of a fluid droplet from a particular nozzle is timed with the movement of the medium to place a fluid droplet at a desired location on the medium. Fluid ejection devices of this type may require continuous or intermittent maintenance to function properly.

SUMMARY

In one aspect, the invention features an ink jet printhead includes: a nozzle plate having an underside and including one or more nozzles in the underside configured to dispense drops of fluid in a dispensing direction; and a multi-level maintenance structure coupled to the nozzle plate such that a gap exists between a portion of the maintenance structure and the underside of the nozzle plate. The maintenance structure includes: a first portion having a first upper surface suspended at a first distance from the underside of the nozzle plate; and a second portion that is coupled to the first portion, the second portion having a second upper surface suspended at a second distance from the underside of the nozzle plate, which is greater than the first distance, the second upper surface laterally displaced relative to the first upper surface. Each of the first and second portions of the maintenance structure defines one or more openings extending in the dispensing direction, the one or more openings aligned with the one or more nozzles in the dispensing direction and configured to allow drops of fluid dispensed by the one or more nozzles to pass through the maintenance structure.

In some examples, a dimension of the first distance is such that a narrow region exists between the underside of the nozzle plate and the first upper surface, the narrow region being configured to induce sufficient capillary action to draw excess drops of fluid away from the one or more nozzles.

In some applications, the printhead further includes a maintenance fluid source in fluid communication with the gap, the maintenance fluid source being configured to inject a flow of maintenance fluid into the gap, the flow in a direction substantially perpendicular to the dispensing direction.

In some cases, the one or more nozzles include an array of nozzles arranged in ordered columns, and wherein the one or more openings defined by the second portion of the maintenance structure include a plurality of closed shape openings, each of the closed shape openings aligned with a respective nozzle of the array. In some applications, the first portion of the maintenance structure includes multiple discrete segments separated by a lateral distance to define a channel spanning across multiple nozzles of a column, the channel including the one or more openings defined by the first portion of the maintenance structure.

In some embodiments, the first portion of the maintenance structure includes a planar portion defining a plurality of discrete, closed shape openings aligned with the nozzles of the array, and the closed shape openings of the first portion are larger than the closed shape openings of the second portion.

In some implementations, the second upper surface includes a non-wetting surface.

In another aspect, the invention features an ink jet printhead including: a nozzle plate including one or more nozzles configured to dispense drops of fluid in a dispensing direction; and a maintenance structure directly attached to the nozzle plate such that a gap exists between the maintenance structure and an underside of the nozzle plate, the maintenance structure defining one or more openings aligned with the one or more nozzles in the dispensing direction with each of the openings being configured to allow drops of fluid dispensed by the one or more nozzles to pass through the maintenance structure; and a maintenance fluid source in communication with the gap, the maintenance fluid source being configured to inject a flow of maintenance fluid into the gap such that the maintenance fluid flows in a direction substantially perpendicular to the dispensing direction.

In some embodiments, the maintenance fluid includes a vapor carrying a solvent.

In some examples, the solvent concentration of the vapor is sufficient to maintain a non-drying environment in the gap.

In some applications, the maintenance fluid includes a cleaning fluid.

In some implementations, the maintenance fluid includes pressurized gas.

In some embodiments, the printhead further includes a sealing cap releasably coupled to an underside of the maintenance structure, the cap effectively sealing the one or more openings of the maintenance structure.

In some examples, the maintenance structure further includes an outer IR reflection surface facing away from the nozzle plate.

In yet another aspect, the invention features a method for ink jet printing includes: dispensing printing fluid from one or more nozzles carried by a nozzle plate; maintaining a non-drying environment proximate the one or more nozzles by selectively injecting vapor into a gap between the nozzle plate and a maintenance structure directly attached to the nozzle plate; and directing fluid, dispensed from the one or more nozzles, through one or more openings formed in the maintenance structure.

In some applications, the method further includes ceasing the dispensing of printing fluid from the one or more nozzles; and introducing a flow of cleaning fluid to the gap, the flow of cleaning fluid being substantially perpendicular to a printing fluid dispensing direction.

In some cases, the method further includes introducing, during the dispensing of printing fluid from the one or more nozzles, a gas flow to the gap, the gas flow being substantially perpendicular to a printing fluid dispensing direction. In some implementations, a pressure level across the gap is approximately constant. In some examples, a nominal pressure of the gas flow is less than a bubble pressure at the one or more openings of the maintenance structure.

In some embodiments, maintaining a non-drying environment includes maintaining a saturated or super-saturated environment.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Many of the levels, sections and features are exaggerated to better show the features, process steps, and results. Like reference numbers and designations in the various drawings indicate like elements.

DETAILED DESCRIPTION

Fluid droplet ejection can be implemented with a substrate (e.g., a micro electromechanical system (MEMS)) that includes a fluid flow path body, a membrane, and a nozzle plate. The flow path body has a fluid flow path formed therein. In a particular configuration, the fluid flow path includes a fluid fill passage, a fluid pumping chamber, a descender, and a nozzle having an outlet. Of course, other suitable configurations of the flow path can also be implemented. In some examples, an actuator is located on a surface of the membrane opposite the flow path body and proximate to the fluid pumping chamber. When activated, the actuator imparts a pressure pulse to the fluid pumping chamber to cause ejection of a droplet of fluid through the outlet. Frequently, the flow path body includes multiple fluid flow paths and nozzles.

A fluid droplet ejection system can include the substrate described above. The system can also include a source of fluid for the substrate. A fluid reservoir can be fluidically connected to the substrate for supplying fluid for ejection. The fluid can be, for example, a chemical compound, a biological substance, or ink.

Figure 1:
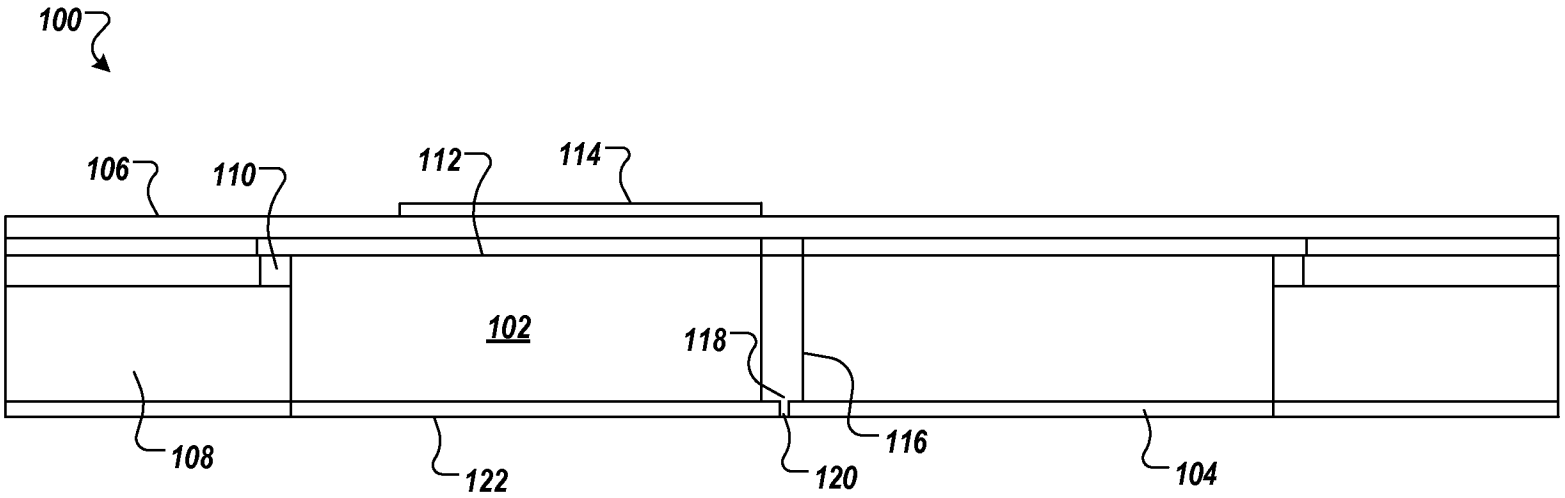
FIG. 1 is a cross-sectional side view of substrate for implementing fluid droplet ejection.

Referring to FIG. 1, a cross-sectional schematic diagram of a portion of a micro electromechanical device, such as a printhead in one implementation is shown. The printhead includes a substrate 100. The substrate 100 includes a fluid path body 102, a nozzle plate 104, and a membrane 106. A fluid reservoir supplies a fluid fill passage 108 with printing fluid. The fluid fill passage 108 is fluidically connected to an ascender 110. The ascender 110 is fluidically connected to a fluid pumping chamber 112. The fluid pumping chamber 112 is in close proximity to an actuator 114. The actuator 114 can include piezoelectric material, such as lead zirconium titanate (PZT), sandwiched between a drive electrode, and a ground electrode. An electrical voltage can be applied between the drive electrode and the ground electrode of the actuator 114 to apply a voltage to the actuator and thereby activate the actuator. The membrane 106 is between the actuator 114 and the fluid pumping chamber 112. An adhesive layer (not shown) can secure the actuator 114 to the membrane 106.

The nozzle plate 104 is secured to a bottom surface of the fluid path body 102 and can have a thickness between about 1 and 100 microns (e.g., between about 5 and 50 microns or between about 15 and 35 microns). A nozzle 118 having an outlet 120 is formed in an outer surface 122 of the nozzle plate 104. The fluid pumping chamber 112 is fluidically connected to a descender 116, which is fluidically connected to the nozzle 118. While FIG. 1 shows various passages, such as a fluid fill passage, pumping chamber, and descender, these components may not all be in a common plane. In some implementations, two or more of the fluid path body, the nozzle plate, and the membrane may be formed as a unitary body.

Routine maintenance is often needed to keep the nozzles of a printhead operating properly. In heated environments, for example, printheads running with volatile inks such as the commonly used solvent and aqueous inks must be carefully managed to prevent the drying of inks in the nozzles. For instance, if the printhead is idle for a long period of time, a cap can be placed on the outer surface of the nozzle plate. The cap seals the outlets of the nozzles to prevent ink from drying and clogging the nozzles. Within the small enclosed space under the cap, the solvent vapor concentration can rise and approach a saturated or supersaturated condition. There are, however, several disadvantages related to "capping" the printhead with a body that directly contacts the nozzle plate for the purpose of preventing ink drying. One drawback is that a capped nozzle plate is generally not able to immediately start printing. It usually needs to be wiped to clean off the residue of ink around the seal area.

One other maintenance concern in operating printheads is that the nozzle plates typically need to be cleaned periodically to remove accumulated residue, e.g., ink, or other debris that can impact jetting performance. For example, the surface of the nozzle plate can be washed with a cleaning fluid, and then wiped with an absorbent material or an elastomeric blade. However, contacting the nozzle plate can result in damage to the nozzles or a coating (e.g., a non-wetting coating) deposited on the nozzle plate.

Figure 2A:
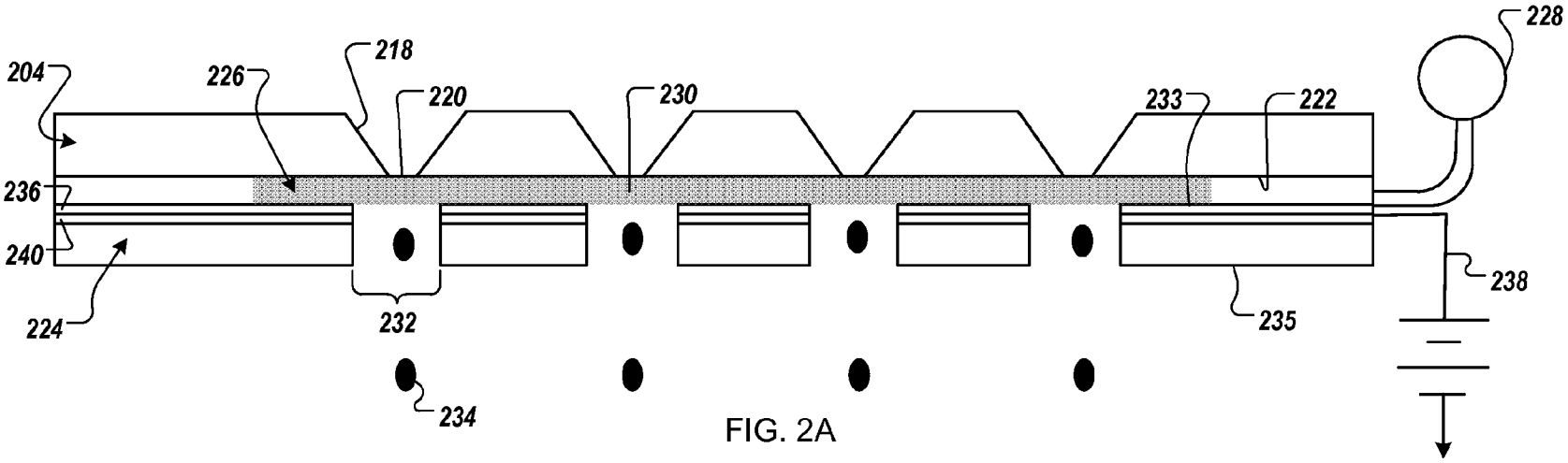
FIG. 2A is a cross-sectional side view of a nozzle plate carrying a maintenance structure.

FIG. 2A shows a nozzle plate 204 (e.g., the nozzle plate 104 from the fluid droplet ejection system shown in FIG. 1) with a maintenance structure 224 positioned adjacent an outer surface 222 of the nozzle plate 204. The nozzle plate 204 includes multiple nozzles 218 having outlets 220 for ejecting or "jetting" fluid droplets 234. The maintenance structure 224 is configured and positioned relative to the outer surface 222 of the nozzle plate 204, such that a gap 226 is maintained between the nozzle plate 204 and at least a portion of the maintenance structure 224. In some examples, the maintenance structure 224 is permanently bonded to the nozzle plate 204, for example, using an adhesive or appropriate fusion bonding techniques. In other examples, the maintenance structure 224 is secured by a mechanical fastener, e.g., a clamp at the edge of the maintenance structure and substrate. The maintenance structure 224 can be a monolithic body (e.g., a unitary silicon body) or a multi-component build (e.g., a layered structure).

The overall thickness of the maintenance structure 224 can be about 10-200 microns. The thickness of the maintenance structure can be controlled by several different factors. For example, as a practical matter, manufacturing processes and durability concerns might suggest a certain thickness of the maintenance structure. Yet, in many cases, it is desirable to make the maintenance structure as thin as possible to account for any inconsistencies in the jetting straightness of the fluid droplets. A thicker maintenance structure would require larger openings (e.g., openings 232 described below) to allow the fluid droplets to pass through the maintenance structure unimpeded. Using larger openings makes it more difficult to maintain a high solvent concentration environment in the gap between the nozzle plate and the maintenance structure. In addition, a thicker maintenance structure effectively increases the travel distance of the fluid droplets, which may increase placement errors. The maintenance structure 224 has multiple openings 232 formed therein. Each of the openings 232 is fully enclosed by an edge of the maintenance structure 224 (thus, the openings can be described as having a "closed-shape"). In this example, the openings 232 are circular; however, other closed shapes can also be used. As shown, the openings 232 extend completely through the maintenance structure 224, from its upper surface 233 to its bottom surface 235. The openings 232 can be formed in the maintenance structure 224 using suitable micro-fabrication techniques. When the maintenance structure 224 is attached to the nozzle plate 204, the openings 232 align with the nozzle outlets 220, allowing the ejected fluid droplets 234 to pass through the maintenance structure and onto a printing medium (not shown). The openings 232 can be larger than the corresponding nozzle outlets 220 to account for any alignment tolerances (e.g., alignment with the nozzle plate in the X-Y directions) and operational tolerances (e.g., drop size diameter and/or jet straightness). For example, the openings 232 of the maintenance structure can be at least two times wider, e.g., about two to four times wider than the outlets 220. For example, the nozzle outlets 220 may have an effective width of about 12.5 microns, while the openings 232 of the maintenance structure 224 are about 30-50 microns wide.

A vapor source 228 is provided to introduce a stream of solvent vapor 230 (e.g., a relatively high concentration solvent and air mixture) to the gap 226. The solvent included in the vapor 230 can be similar (or identical) to a solvent used in the ejected fluid, or if the fluid does not include a solvent, then the vapor can contain a component that acts as a solvent to the ejected fluid. As shown, the gap 226 extends continuously across the nozzle outlets 220, such that a region around each nozzle outlet is filled with vapor 230. The presence of the vapor 230 in the gap 226 can create an environment near the nozzle outlets 220 to inhibit or entirely prevent ink in the nozzles 218 from drying. For the purposes of this discussion, the above described environment will be termed a "non-drying environment." For example, the presence of the vapor can create an environment where the solvent content of the ink is at a near equilibrium condition with the partial pressure of the solvent in the air within the gap (when the solvent is water, this type of moisture content equilibrium is expressed in terms of relative humidity). At near equilibrium there is little to no transfer of solvent between the air in the gap and the ink, which prevents the ink from drying. In some cases, to accommodate particularly fast drying inks, the system can be designed such that the presence of the vapor can create a saturated or super saturated environment in the gap. The gap 226 can be designed to sustain the non-drying environment. For example, the open area of the gap 226 may be small enough to maintain a high concentration level of the vapor 230, and also large enough to inhibit a significant pressure drop from one end of the gap to the other (as described below). In this example, the size of the gap 226 is defined by its height (i.e., the distance between the nozzle plate and the maintenance structure, termed the "gap height"), which can be about 50-500 microns.

During use, the vapor source 228 can be operated to provide vapor to the gap 226 when the printhead is idle and/or during printing operations. To uphold jetting uniformity and droplet size consistency during printing, the fluid droplet ejection system can be designed to provide a relatively constant pressure level (e.g., a pressure drop of 2000 pascals or less) along the gap 226 at the nozzle outlets 220. In some implementations, one or more dimensions of the gap 226 (e.g., the gap height, width, and length) can be selected to create a system with a relatively constant pressure level. In a particular example, the gap was provided with a height of 100 microns and a width of 200 microns. Other variables (e.g., the dimensions of the maintenance structure openings 232, the surface roughness of the nozzle plate 204 and the maintenance structure 224, and the viscosity of the vapor 230) can also be selected to achieve a constant pressure level in the gap 226. In some examples, a non wetting coating is applied to the outer surface 222 of the nozzle plate 204 and/or the inner surface 233 of the maintenance structure 224 to mitigate pressure drop.

Figure 2B:
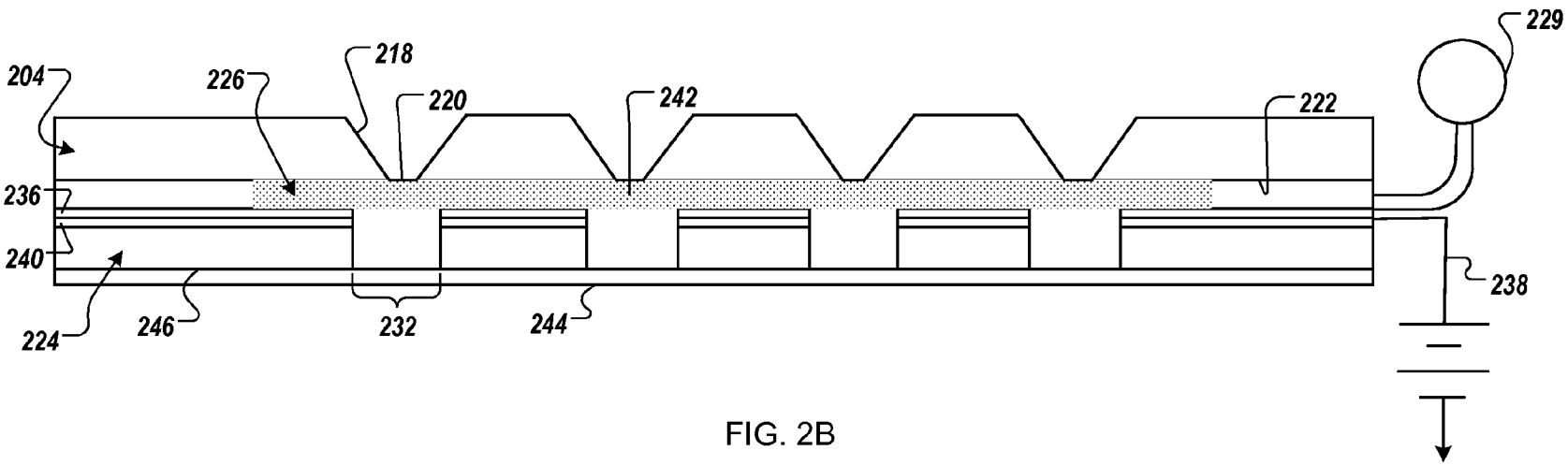
FIG. 2B is a cross-sectional side of the nozzle plate of FIG. 2A carrying a maintenance structure that is capped.

In addition to facilitating a non-drying environment to inhibit ink drying in the nozzles 218, the gap 226 provided by the maintenance structure 224 can be used for intermittent cleaning of the printhead. For example, referring to FIG. 2B, a cleaning fluid 242 can be injected into the gap 226 (e.g., by a cleaning fluid source 229) to clean the nozzles 218. As shown, a cap 244 can be temporarily attached to the outer surface 246 of the maintenance structure 224 to seal the openings 232, thereby inhibiting leakage of the cleaning fluid 242 from the gap 226. The cleaning operation can also be performed without capping the maintenance structure 224. Capping can be avoided, for example, if the pressure in the gap 226 does not exceed a "bubble pressure" at the openings 232. The bubble pressure is defined as: two times the surface tension of the cleaning fluid 242, divided by the radius of the openings 232. So, for a maintenance structure opening 232 having a radius of 15 microns and a cleaning fluid 242 having a surface tension of 60 mili-Newton/meters, the bubble pressure would be 8000 pascals. Thus, for a 50% engineering safety margin, the cleaning fluid 242 can be injected into the gap 226 with a pressure of up to 4000 pascals. Providing a non wetting coating on the inner surfaces of the maintenance structure 224 may also help to keep the cleaning fluid 242 from leaking through the openings 232.

In some cases, the pressure of the ink in the nozzles 218 can be regulated during the cleaning operation. For example, the ink in the nozzles 218 can be pressurized to approximately the same pressure as the cleaning fluid 242 to inhibit any mixing of the two fluids. Alternatively, the ink in the nozzles 218 can be maintained at a lower pressure than the cleaning fluid 242. In this case, some of the cleaning fluid 242 may be pushed upward into the nozzles 218. Accordingly, the nozzles 218 would need to run for a period of time after the cleaning operation (and before printing) to clear them of any ingress cleaning fluid. Yet another approach would include pressurizing the ink in the nozzles 218 to a higher pressure than the cleaning fluid 242. In this case, the pressure differential would need to be regulated so that the concentration of the ink in the cleaning fluid 242 is not high enough to cause the ink to leave a harmful residue on the nozzle plate surface 222.

The maintenance structure 224 can be configured to provide some further utility functions (i.e., functions in addition to the maintenance functions of ink drying prevention and intermittent cleaning). For example, the maintenance structure 224 can also be designed to provide the utility function of capturing "satellite drops". Generally, the formation of ejected fluid drops is largely defined by the difference in the speed between the head and the tail of the drop. In many cases, the head of the drop travels at a much faster speed than the tail. This effect creates a drop that is elongated in flight and which eventually breaks up into a head and one or more small satellite drops. These satellite drops are slower than the main drop and so as the printing speed increases, they may land on the printing medium increasingly farther away from the main drop, resulting in noticeable image degradation (e.g., edge raggedness and color shifts). To mitigate this undesired effect, the maintenance structure can include a metal layer 236 (as well as an insulating layer 240 beneath the metal layer) and a voltage source 238 connected to the metal layer. The voltage source 238 may positively charge the metal layer 236. As the fluid drops are ejected by the nozzles 218, the satellite drops (which are inherently negatively charged) are attracted to, and captured by, the maintenance structure, while the larger heads of the fluid drops are less affected by the electrostatic field.

The maintenance structure 224 can also be designed to provide the additional utility function of deflecting heat away from the nozzle plate 204. For example, the outside surface 246 of the maintenance structure 224 can be plated with an infrared (IR) reflection surface (e.g., a gold surface) to reflect IR heat emanating from an area beneath the nozzle plate 204.

In some implementations, the maintenance structure can be adapted to further facilitate intermittent cleaning of the nozzle plate. Generally, when a nozzle plate is flushed with a cleaning fluid (as described above), some of the cleaning fluid tends to remain inside the gap between the maintenance structure and the nozzle plate, which may interfere with operation of the nozzles during printing. To remove the remaining cleaning fluid from the nozzle plate, the attached maintenance structure can be designed to provide narrow regions in the gap that are located near or surrounding the nozzle outlets. The dimensions of the narrow regions can be sufficient to induce capillary action that draws the remaining cleaning fluid away from the nozzle outlets. For example, the gap height at the narrow regions can be about 10-50 microns.

Figure 3A:
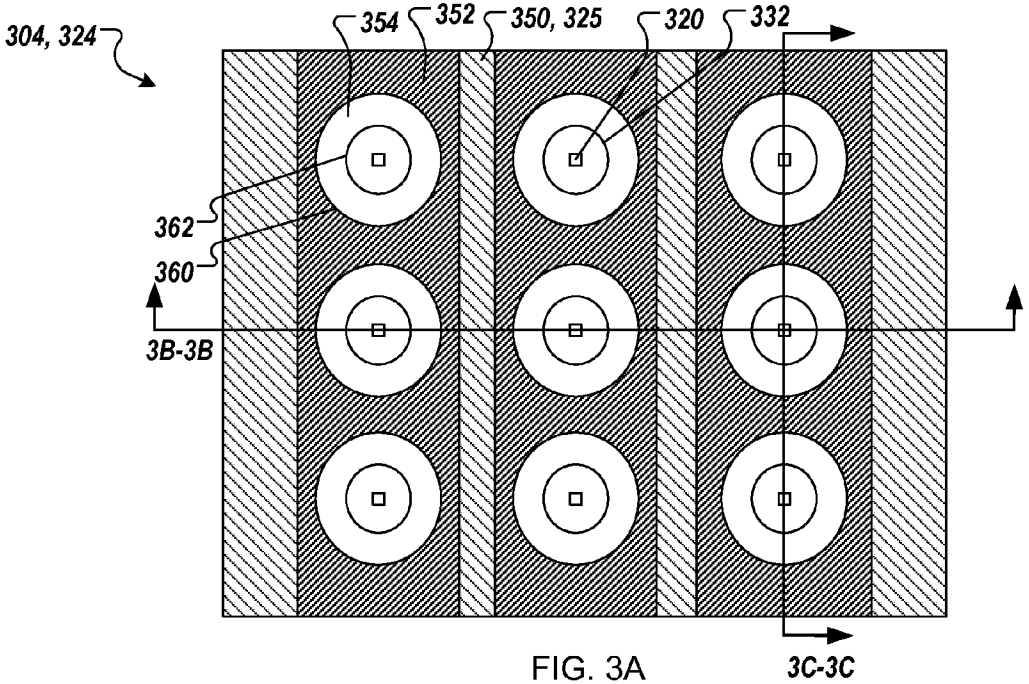
FIG. 3A is a plan view of a nozzle plate carrying a first example maintenance structure that is adapted to facilitate cleaning of the nozzle plate.
Figure 3B:
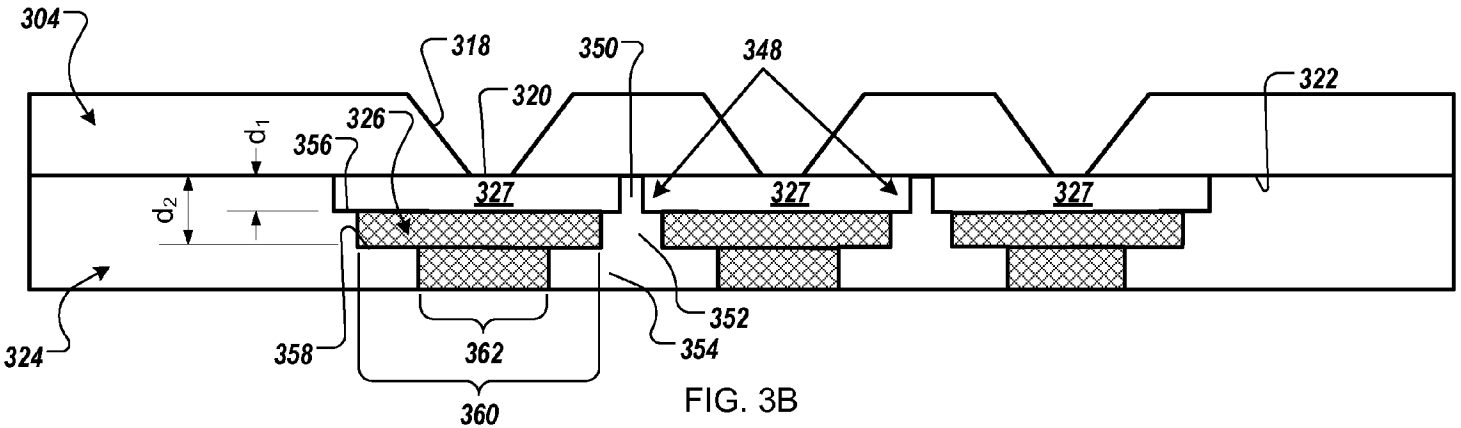
FIG. 3B is a cross-sectional side view along line 3B-3B of FIG. 3A.
Figure 3C:
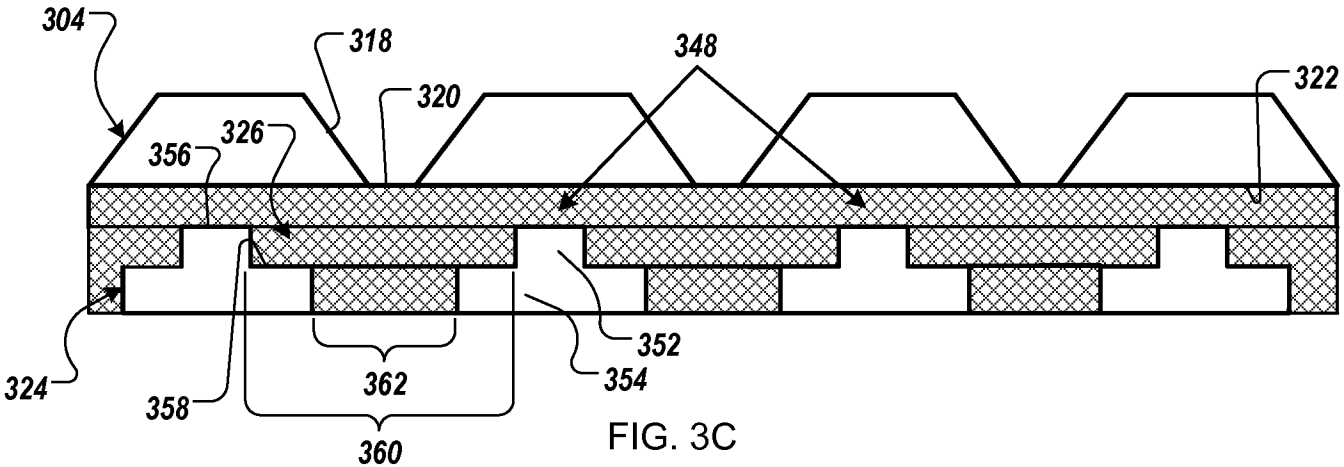
FIG. 3C is a cross-sectional side view along line 3C-3C of FIG. 3A.

FIGS. 3A, 3B and 3C show a nozzle plate 304 (e.g., the nozzle plate 104 shown in FIG. 1, or the nozzle plate 204 shown in FIGS. 2A and 2B) with a first example maintenance structure 324 positioned adjacent an outer surface 322 of the nozzle plate 304. As shown, the maintenance structure 324 is positioned relative to the nozzle plate outer surface 322 such that a gap 326 is maintained between the nozzle plate 304 and at least a portion of the maintenance structure 324. The nozzle plate 304 includes an array of nozzles 318 having outlets 320 for jetting fluid droplets in a dispensing direction. In this example, the maintenance structure 324 has been adapted to facilitate cleaning of the array of nozzles 318. The maintenance structure 324 is a multi-level body including an attachment level 350, a first level section 352 (below the attachment level), and a second level section 354 (below the first level section). As in the previous example, the maintenance structure 324 can be a monolithic body or a multi-component build, where one or more sections of the structure are formed as separate components.

In this example, the attachment level 350 includes a set of longitudinally continuous rails bonded directly to stripes 325 on the outer surface 322 of the nozzle plate 304. As shown, the attachment level 350 separates the gap 326 into multiple isolated channels 327 (three isolated channels in this example illustration) running parallel to one another along the length of the nozzle plate 304. The channels 327 of the gap 326 are aligned with respective columns of the array of nozzles 318.

The first level section 352 is coupled to the attachment level 350, suspended beneath the nozzle plate 304 away from the outer surface 322. In this example, the first level section 352 is a relatively planar member that extends contiguously across the nozzle plate 304. An upper surface 356 of the first level section 352 is located at a first distance $d_1$ (e.g., about 10-50 microns), in the dispensing direction, from the nozzle plate outer surface 322, forming narrow regions 348 of the gap 326. The distance $d_1$ can be selected such that the narrow regions 348 induce capillary action that draws at least a portion of any remaining cleaning fluid away from the nozzle outlets 320. Further, as shown, the first level section 352 includes multiple closed-shape (e.g., circular) openings 360 that are aligned with the array of nozzles 318.

The second level section 354 of the maintenance structure 324 is coupled to the first level section 352. Similar to the first level section 352, the second level section 354 is relatively planar and extends contiguously across the nozzle plate 304. The upper surface 358 of the second level section 354 is located at a second distance $d_2$ from the nozzle plate outer surface 322, which is greater than the first distance $d_1$, forming a wider region of the gap 326. The second level section 354 also includes multiple closed-shape (e.g., circular) openings 362 that are aligned with the array of nozzles 318. Together, the openings 360 and 362 allow fluid droplets ejected by the nozzles 318 to pass through the maintenance structure 324 and onto a printing medium (not shown). In this example, the openings 362 of the second level section 354 are smaller than the openings 360 of the first level section 352. However, the design and arrangement of the openings 360 and 362 can vary between embodiments. The openings 360 and 362 can, for example, have a similar or different shape and size, and can be concentric or partially offset from one another.

Figure 4A:
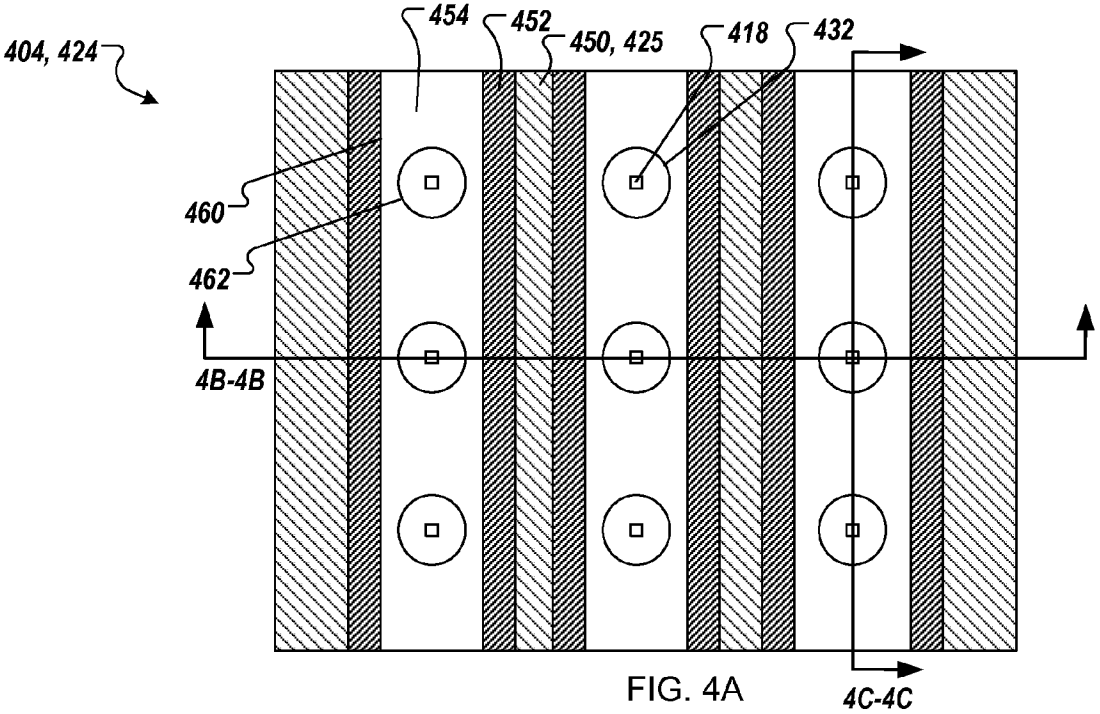
FIG. 4A is a plan view of a nozzle plate carrying a second example maintenance structure that is adapted to facilitate cleaning of the nozzle plate.
Figure 4B:
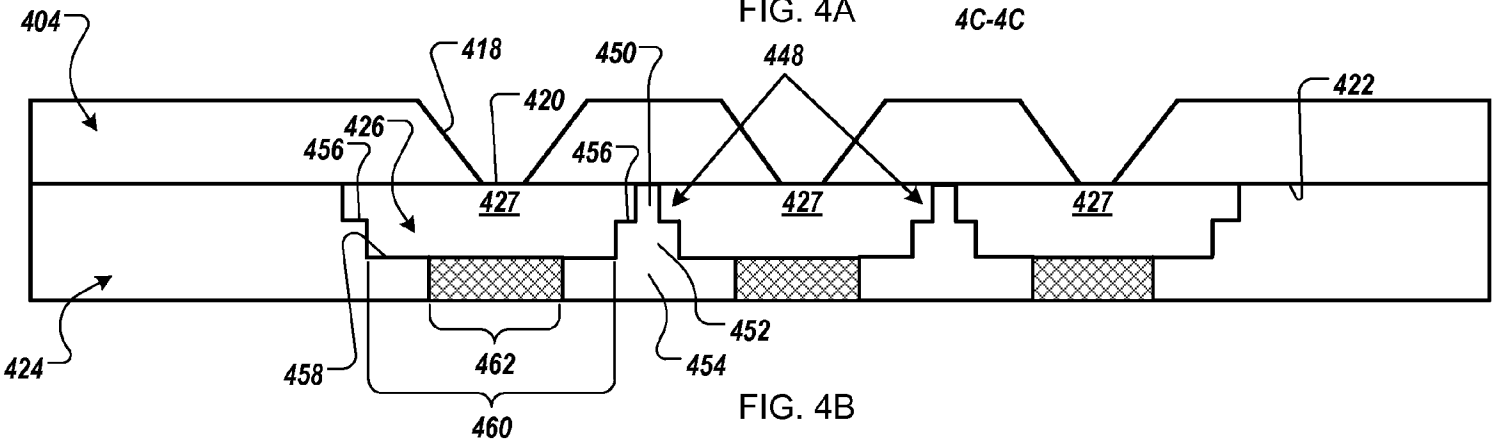
FIG. 4B is a cross-sectional side view along the line 4B-4B of FIG. 4A.
Figure 4C:
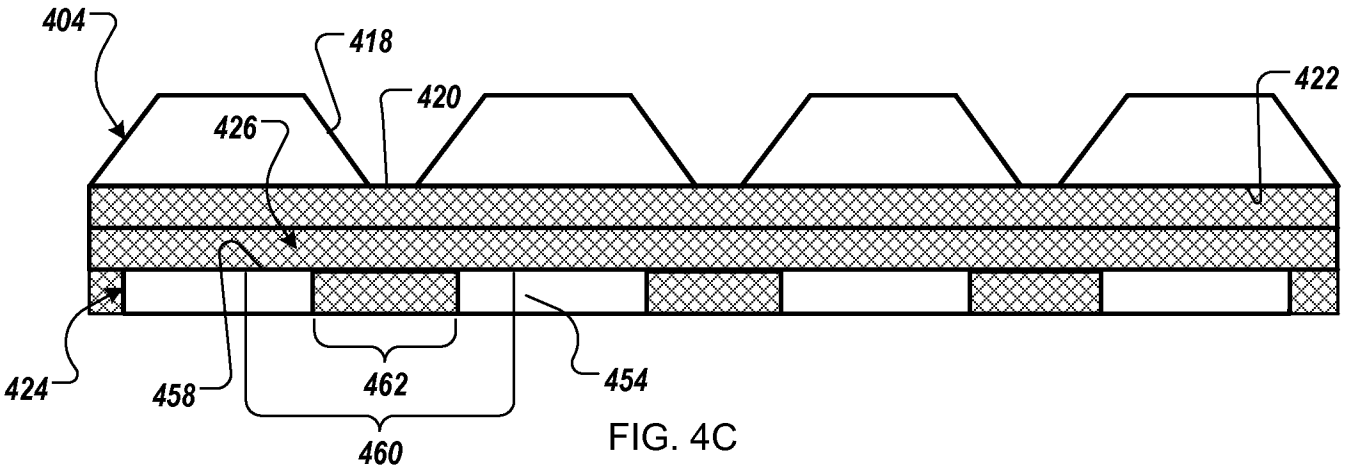
FIG. 4C is a cross-sectional side view along line 4C-4C of FIG. 3A.

FIGS. 4A,4B, and 4C show a nozzle plate 404 (e.g., the nozzle plate 104 shown in FIG. 1, or the nozzle plate 204 shown in FIGS. 2A and 2B) with a second example maintenance structure 424 positioned adjacent an outer surface 422 of the nozzle plate 404. As shown, the maintenance structure 424 is positioned relative to the nozzle plate outer surface 422 such that a gap 426 is maintained between the nozzle plate 404 and at least a portion of the maintenance structure 424. The nozzle plate 404 includes an array of nozzles 418 having outlets 420 for jetting fluid droplets. The maintenance structure 424 has been adapted to facilitate cleaning of the array of nozzles 418.

The maintenance structure 424 is similar to the maintenance structure 324, including an attachment level 450, a first level section 452, and a second level section 454. Again, the attachment level 450 includes a set of longitudinally continuous rails bonded directly to stripes 425 on the outer surface 422 of the nozzle plate 404. As shown, the attachment level separates the gap 426 into isolated channels 427 aligned with respective columns of the nozzles 418. The first level section 452 is coupled to the attachment level 450, such that an upper surface 456 of the first level section, which is located at a first distance $d_1$ from the nozzle plate 404, cooperates with the nozzle plate outer surface 422 to form the narrow regions 448. The distance $d_1$ can be selected such that the narrow regions 448 induce capillary action that draws at least a portion of any remaining cleaning fluid away from the nozzle outlets 420.

In this example, the first level section 452 includes multiple discrete segments that run parallel to one another longitudinally across the nozzle plate 402. The discrete segments form narrow regions 448 that run as stripes along the nozzle plate 402, adjacent the rails of the attachment level. The lateral distance between segments of the first level section 452 forms respective channels 460 that are aligned with the columns of nozzles 418. Similar to the previous example, the second level section 454 is relatively planar and extends contiguously across the nozzle plate 404. The upper surface 458 of the second level section 454 is located at a second distance $d_2$ from the nozzle plate 404, which is greater than the first distance $d_1$, forming a wider region in the gap 426. As shown, the wider region runs as a stripe between the narrow regions 448. The second level section 454 also includes multiple closed-shape openings 462 that are aligned with the array of nozzles 418. Together, the openings 460 and 462 allow fluid droplets ejected by the nozzles 418 to pass through the maintenance structure 424 and onto a printing medium (not shown).

In some cases, e.g., for either FIGS. 3A-3C or FIGS. 4A-4C, the capillary action induced by narrow regions of the gap, e.g., 348 or 448, between the nozzle plate and the maintenance structure is unable to remove all of the remaining cleaning fluid, for example, when several small drops of cleaning fluid coalesce to form a large drop on the nozzle plate. To account for this effect, pressurized gas (e.g., air) can be injected into the gap to help move large drops of the remaining cleaning fluid towards the narrow regions. The pressurized air can also be used to clear any fluid from the maintenance structure openings. To clear fluid from openings in the maintenance structure, the gas is pressurized above the bubble pressure of the cleaning fluid at the openings, causing both lingering fluid and the pressurized air to flow out of the openings. This can have the added advantage of preventing ingress of particles and dust into the gap and contaminating the nozzles. In some examples, the pressurized air is continuously injected into the gap during printing operations. Accordingly, the system should be designed to maintain a relatively constant pressure level from one end of the gap to the other end (as describe above).

Figure 5A:
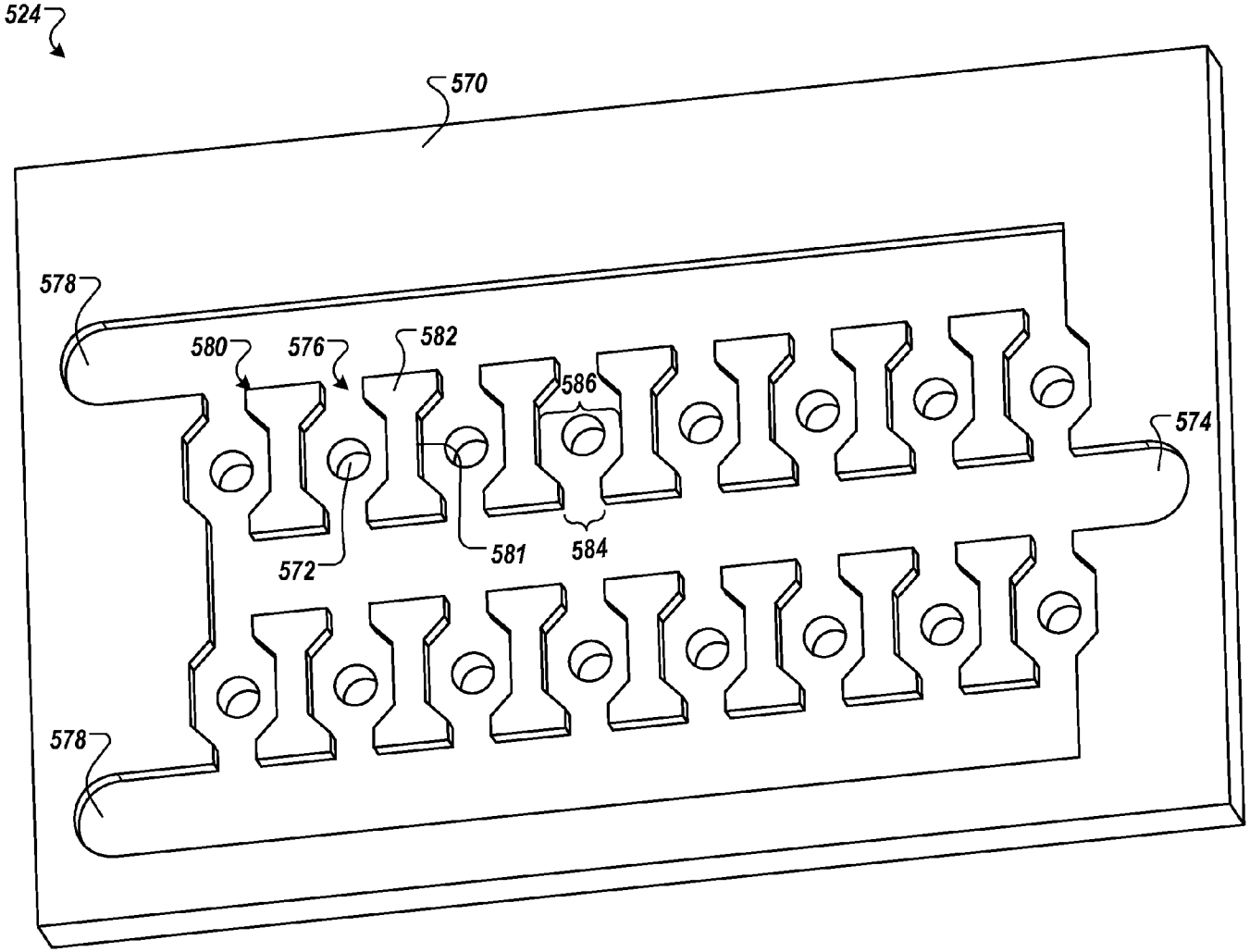
FIG. 5A is a perspective view of a maintenance structure designed to mitigate pressure drop.

FIG. 5A shows another example maintenance structure 524 that can be attached to the outer surface of a nozzle plate. Similar to the previous examples, the maintenance structure is designed to provide a gap for introducing a maintenance fluid to the nozzle openings. Maintenance structure 524 includes a base 570 defining a manifold design of features. For example, the maintenance structure 524 features an array of openings 572 that align with the nozzles of the nozzle plate to allow ejected fluid droplets to pass through the maintenance structure. The maintenance structure 524 also includes an inlet passage 574, several distribution passages 576 formed over the array of openings 572, and opposing outlet passages 578. The inlet passage 574 aligns with a fluid source configured to inject maintenance fluid into the gap between the maintenance structure and the nozzle plate. Maintenance fluid flows from the inlet passage 574, to circulate through the various distribution passages 576, and finally to the opposing outlet passages 578.

The distribution passages 576 are formed between neighboring fluid flow partitions 580. As shown, the partitions 580 have an hour-glass shape, defining a thin neck 581 bracketed on either side by a wide head portion 582. Of course, the shape of the partitions 580 defines the shape of the distribution passages 576. Accordingly, the distribution passages 576 feature a narrow throat 584, where the head portions 582 of the partition 580 are aligned, and a wide mid-section 586, where the thin necks 581 are aligned. The mid-section 586 of each distribution passage 576 is aligned with a corresponding opening 572.

Each of the distribution passages 576 provides a flow resistance or pressure drop across the gap between maintenance structure and the nozzle plate, from the inlet passage 574 to the outlet passages 578. As noted above, to uphold jetting uniformity and droplet size consistency during printing, the fluid droplet ejection system can be designed to provide a relatively constant pressure level across the gap by minimizing the pressure drop. In this example, the pressure drop is mitigated by forming the inlet passage 574 between the distribution passages 576, and forming the outlet passages on either side of the distribution passages. This configuration can provide between 10-100 times less total pressure drop than if the distribution passages 576 were all formed inline and parallel.

Figure 5B:
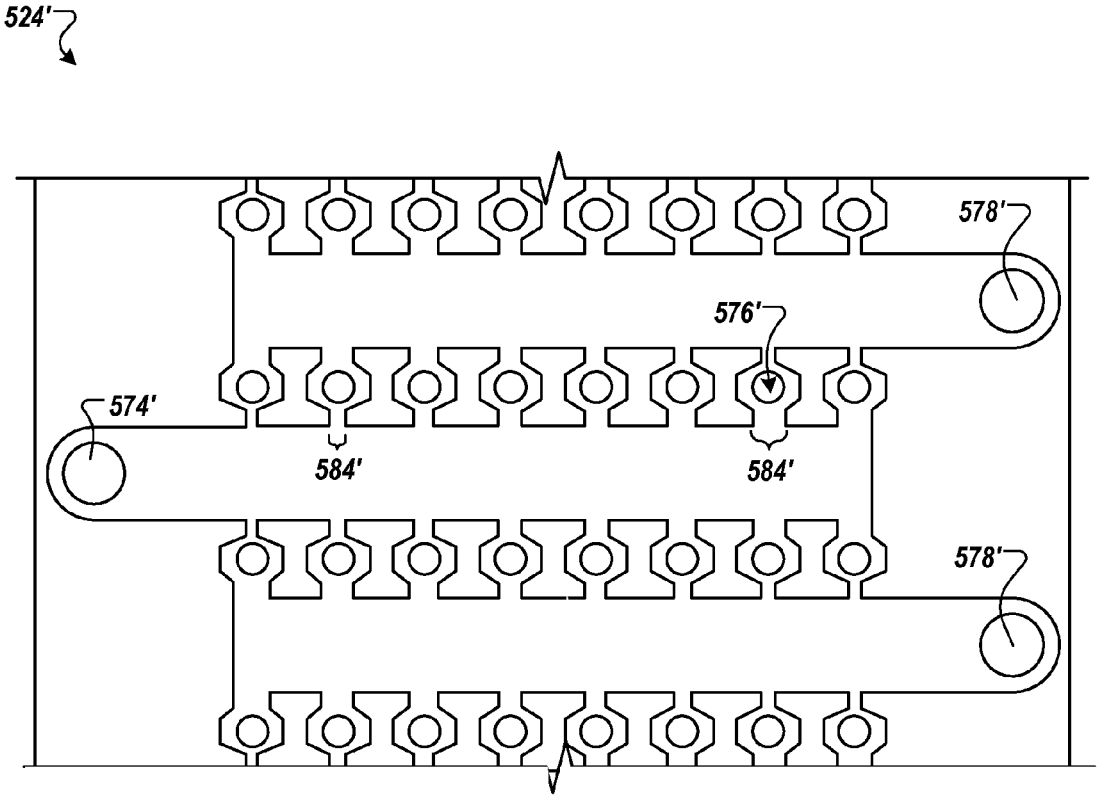
FIG. 5B plan view of a maintenance structure designed to distribute pressure drop.

If the overall pressure drop caused by the flow passages is too great to maintain sufficient jetting uniformity and droplet size consistency, the maintenance structure can be designed to spread the pressure drop unevenly across gap by controlling the size of the throat of each distribution passage. This way, there is more pressure drop at the inlet end of the gap, where the pressure would be relatively high, and less pressure drop at the outlet end of the gap, where the pressure would be relatively low. The end resulting should be a similar pressure at either end. The maintenance structure shown in FIG. 5B is designed to incorporate this technique. For example, as shown, the maintenance structure 524' is designed such that the size of the throat 584' of each distribution passage 576' progressively increases along the gap, from the inlet passage 574' toward the outlet passages 578'. The narrower throats at the inlet end of the gap provide the higher pressure drop, and the wider throats at the outlet end provide the lower pressure drop.

The use of terminology such as "front," "back," "top," "bottom," "over," "above," and "below" throughout the specification and claims is for describing the relative positions of various components of the system, printhead, and other elements described herein. Similarly, the use of any horizontal or vertical terms to describe elements is for describing relative orientations of the various components of the system, printhead, and other elements described herein. Unless otherwise stated explicitly, the use of such terminology does not imply a particular position or orientation of the printhead or any other components relative to the direction of the Earth gravitational force, or the Earth ground surface, or other particular position or orientation that the system, printhead, and other elements may be placed in during operation, manufacturing, and transportation.

A number of embodiments of the invention have been described. Nevertheless, it will be understood that various modifications may be made without departing from the spirit and scope of the inventions.

What is claimed is:

1. An ink jet printhead comprising:

a nozzle plate having an underside and comprising one or more nozzles in the underside configured to dispense drops of fluid in a dispensing direction;

a multi-level maintenance structure coupled to the nozzle plate such that a gap exists between a portion of the maintenance structure and the underside of the nozzle plate, the maintenance structure comprising:

a first portion having a first upper surface suspended at a first distance from the underside of the nozzle plate; and a second portion that is coupled to the first portion, the second portion having a second upper surface suspended at a second distance from the underside of the nozzle plate, which is greater than the first distance, the second upper surface laterally displaced relative to the first upper surface, wherein each of the first and second portions of the maintenance structure defines one or more openings extending in the dispensing direction, the one or more openings aligned with the one or more nozzles in the dispensing direction and configured to allow the drops of fluid dispensed by the one or more nozzles to pass through the maintenance structure, wherein the one or more nozzles comprise an array of nozzles arranged in ordered columns, and wherein the one or more openings defined by the second portion of the maintenance structure comprise a plurality of closed shape openings, each of the closed shape openings aligned with a respective nozzle of the array; and a maintenance fluid source in fluid communication with the gap, the maintenance fluid source being configured to inject a flow of maintenance fluid into the gap, the flow in a direction substantially perpendicular to the dispensing direction, the maintenance fluid comprising a vapor carrying a solvent, wherein a solvent concentration of the vapor is sufficient to maintain a non-drying environment in the gap.

2. The ink jet printhead of claim 1, wherein a dimension of the first distance is such that a narrow region exists between the underside of the nozzle plate and the first upper surface, the narrow region being configured to induce sufficient capillary action to draw excess drops of fluid away from the one or more nozzles.

3. The ink jet printhead of claim 1, wherein the first portion of the maintenance structure comprises multiple discrete segments separated by a lateral distance to define a channel spanning across multiple nozzles of a column of the plurality of columns, the channel comprising the one or more openings defined by the first portion of the maintenance structure.

4. The ink jet printhead of claim 1, wherein the first portion of the maintenance structure comprises a planar portion defining a plurality of discrete, closed shape openings aligned with the nozzles of the array, and wherein the closed shape openings of the first portion are larger than the closed shape openings of the second portion.

5. The ink jet printhead of claim 1, wherein the second upper surface comprises a non-wetting surface.

6. An ink jet printhead comprising:

a nozzle plate comprising one or more nozzles configured to dispense drops of fluid in a dispensing direction; and a maintenance structure directly attached to the nozzle plate such that a gap exists between the maintenance structure and an underside of the nozzle plate, the maintenance structure defining one or more openings extending through an entire thickness of the maintenance structure, wherein a top face and a bottom face of the one or more openings are aligned with the one or more nozzles in the dispensing direction with each of the one or more openings being configured to allow the drops of fluid dispensed by the one or more nozzles to pass unimpeded through the maintenance structure; and a maintenance fluid source in communication with the gap, the maintenance fluid source being configured to inject a flow of maintenance fluid comprising a vapor carrying a solvent into the gap such that the maintenance fluid flows in a direction substantially perpendicular to the dispensing direction, wherein a solvent concentration of the vapor is sufficient to maintain a non-drying environment in the gap.

7. The ink jet printhead of claim 6, wherein the maintenance fluid comprises pressurized gas.

8. The ink jet printhead of claim 6, further comprising a sealing cap releasably coupled to an underside of the maintenance structure, the cap effectively sealing the one or more openings of the maintenance structure.

9. The ink jet printhead of claim 6, wherein the maintenance structure further comprises an outer IR reflection surface facing away from the nozzle plate.

* * * * *